US007644719B2

(12) United States Patent
Galanty

(10) Patent No.: US 7,644,719 B2
(45) Date of Patent: Jan. 12, 2010

(54) WALKER TIP

(76) Inventor: Margaret Galanty, 11479 Conch Ct., Venice, FL (US) 34292

( * ) Notice: Subject to any disclaimer, the term of this patent is extended or adjusted under 35 U.S.C. 154(b) by 0 days.

(21) Appl. No.: 12/138,593

(22) Filed: Jun. 13, 2008

(65) Prior Publication Data

US 2009/0308420 A1 Dec. 17, 2009

(51) Int. Cl.
*A61H 3/04* (2006.01)
*A45B 9/04* (2006.01)

(52) U.S. Cl. ..... 135/67; 135/85; 16/42 R; 482/68

(58) Field of Classification Search ..... 135/65–67, 135/77, 84–86; 16/42 R, 42 T; 248/188.1, 248/188.4, 188.9; 150/104.001; 280/642, 280/87.021, 87.031; 482/68
See application file for complete search history.

(56) References Cited

U.S. PATENT DOCUMENTS 1,438,883 A * 12/1922 Youngren ..... 135/83
1,663,622 A * 3/1928 Atkinson ..... 135/86
3,467,117 A * 9/1969 Lucibello ..... 135/77
4,222,806 A 9/1980 Parker
4,616,828 A 10/1986 Haythornthwaite
4,739,989 A 4/1988 Prinz et al.
5,191,676 A * 3/1993 Gerner ..... 16/42 T
5,224,506 A 7/1993 Allen et al.
5,379,975 A * 1/1995 Berkowitz et al. ..... 248/188.8
5,509,629 A * 4/1996 Sassmannshausen et al. ..... 248/171
5,573,213 A 11/1996 Henderson et al.
5,692,762 A 12/1997 Obitts
5,778,605 A 7/1998 Ellena et al.
5,945,178 A * 8/1999 Volkmann ..... 428/11
6,418,951 B1 * 7/2002 Douglass ..... 135/67
7,234,199 B2 * 6/2007 Bushey ..... 16/42 R
7,270,138 B2 * 9/2007 Liao ..... 135/82
2003/0226585 A1 12/2003 Burchel
2005/0205122 A1 9/2005 Bly et al.
2006/0207045 A1 * 9/2006 Pyka et al. ..... 15/209.1
2006/0272691 A1 12/2006 DeLesline
2007/0102080 A1 * 5/2007 Spangler ..... 150/154
2008/0244870 A1 * 10/2008 Chase ..... 16/42 R

FOREIGN PATENT DOCUMENTS

WO WO 03005852 A1 * 1/2003

* cited by examiner

*Primary Examiner*—Winnie Yip
(74) *Attorney, Agent, or Firm*—Gifford, Krass, Sprinkle, Anderson & Citkowski, P.C.

(57) ABSTRACT

An improved walker leg tip having a felt nap is provided. The walker leg tip has an arcuate shaped shell with the shell having a top portion and a bottom portion. The top portion has an aperture at least partially therethrough, the aperture dimensioned to accept an end portion of the walker leg. The felt nap covers at least part of the bottom portion of the arcuate shaped shell. In some instances, the arcuate shaped shell is spherically shaped and can be made from a polymer, vulcanized rubber and the like. Optionally, a sleeve can extend from the top portion of the shell, the sleeve having a sleeve aperture that is in alignment with the aperture of the top portion and dimensioned to fit at least partially over an end portion of a walker leg. A removable insert can also be included, the insert having an outer diameter dimensioned to fit at least partially into the aperture of the top portion and an inner diameter dimensioned to fit at least partially onto the end portion of the walker leg.

4 Claims, 1 Drawing Sheet

WALKER TIP

FIELD OF THE INVENTION

The present invention is related to a tip for a walker leg, and in particular to a tip with a felt nap for a walker leg.

BACKGROUND OF THE INVENTION

Walkers are commonly used by individuals having difficulty maintaining their balance and/or needing support during walking. Such walkers typically have a metal or plastic frame with two sides having a pair of parallel legs that extend to the ground or floor. The legs define two front legs and two rear legs, along with an upper frame region where a user can grasp the walker in order to move the frame forward and take support-assisted steps.

The walker may nor may not have wheels mounted on each of the front legs and typically has plastic tips that are mounted at the bottom of each rear leg. During use, the walker is typically moved by sliding the front and rear legs across an underlying surface or floor. The sliding of the plastic tips on the rear legs across the floor or surface can create a chirping noise and produce vibrations that are transmitted to the hands and arms of the user. The chirping noise and vibrations can be a source of irritation for the user and are produced by friction between the plastic tips on the rear legs and the smooth hard surface. The plastic tips that are commonly provided with the walker wear and break especially when used outside.

Some individuals have eliminated the chirping noise and reduced the vibrations by taking a pair of tennis balls, cutting a hole in each ball and then placing one of the tennis balls on the bottom end of each back leg. The chirping noise and vibrations are reduced or prevented at least in part because the tennis balls have a felt nap cover that can provide a satisfactory amount of friction and noise dampening. The outer felt nap is typically a layer of fibrous material that is glued onto a shell of vulcanized rubber with the textile fabric typically including warp and weft threads made of wool and/or synthetic yarn. The nature of the weave is usually not important and can be a simple, single layer weave or a multilayer weave. In addition, the nature of the fibrous web is not critical and those skilled in the art are aware of a variety of fibrous webs that can produce the physical characteristics of a tennis ball fabric covering.

As such, a temporary solution can be provided by the tennis balls, however, the tennis balls can fit loosely on the back leg if the hole is cut improperly, and/or because of wear, thus be knocked off during use. In addition, the outer felt surface wears out with continued use. Therefore, an improved walker leg tip would be desirable.

SUMMARY OF THE INVENTION

An improved walker leg tip having a felt nap is provided. The walker leg tip has an arcuate shaped shell with the shell having a top portion and a bottom portion. The top portion has an aperture at least partially therethrough, the aperture dimensioned to accept an end portion of a walker leg. The felt nap covers at least part of the bottom portion of the arcuate shaped shell and provides friction and noise dampening to the walker leg tip. In some instances, the arcuate shaped shell is spherically shaped and can be made from a polymer, vulcanized rubber and the like.

Optionally, a sleeve can extend from the top portion of the shell, the sleeve having a sleeve aperture that is in alignment with the aperture of the top portion and dimensioned to fit at least partially onto the end portion of the walker leg. A removable insert can also be included, the insert having an outer diameter dimensioned to fit at least partially into the aperture of the shell top portion and an inner diameter dimensioned to fit at least partially onto the end portion of the walker leg.

DETAILED DESCRIPTION OF THE INVENTION

The present invention provides an improved walker leg tip for use with a walker. As such, the walker leg tip has utility as a component for a walker.

The walker leg tip can be attached to an end portion of a front or rear walker leg and has an arcuate shaped shell, the shell having a top portion and a bottom portion. The top portion has an aperture at least partially therethrough, the aperture dimensioned to accept an end portion of a walker leg. Also included is a felt nap that covers at least part of the shell bottom portion. It is appreciated that the bottom portion of the shell comes in contact with a floor or underlying surface when the walker leg tip is attached to the walker and the walker is in use. In some instances, the arcuate shaped shell of the walker leg tip is spherically shaped and can be made from any material known to those skilled in the art, illustratively including polymers, vulcanized rubber and the like. The walker leg tip is preferably silver in color to more closely match the aluminum legs of the walker A sleeve integral with and extending from the top portion of the shell can optionally be included. The sleeve has a sleeve aperture at least partially therethrough which is an alignment with the top portion aperture and is dimensioned to fit at least partially onto the end portion of the walker leg. It is appreciated that the sleeve aperture is dimensioned such that an interference fit between the sleeve and the end portion of the walker leg can be provided.

A removable insert having an outer diameter dimensioned to fit at least partially into the aperture of the top portion or the aperture of the sleeve can also be provided. The removable insert also has an inner diameter dimensioned to fit onto the end portion of the walker leg, with removable inserts having different inner diameters allowing for the walker leg tip to be used on different sized walker legs. For example and for illustrative purposes only, some walkers may have walker legs with an outer diameter equal to ¾ of an inch, while other walkers may have legs with a 1 inch outer diameter. As such, one set of removable inserts can have apertures with a ¾ inch inner diameter while another set of removable inserts can have apertures with a 1 inch inner diameter.

The felt nap on at least part of the bottom portion of the walker leg tip can be any felt nap known to those skilled in the art that provides friction and vibration dampening when the walker is in use. In some instances, the felt nap is a tennis ball felt nap.

Figure 1:
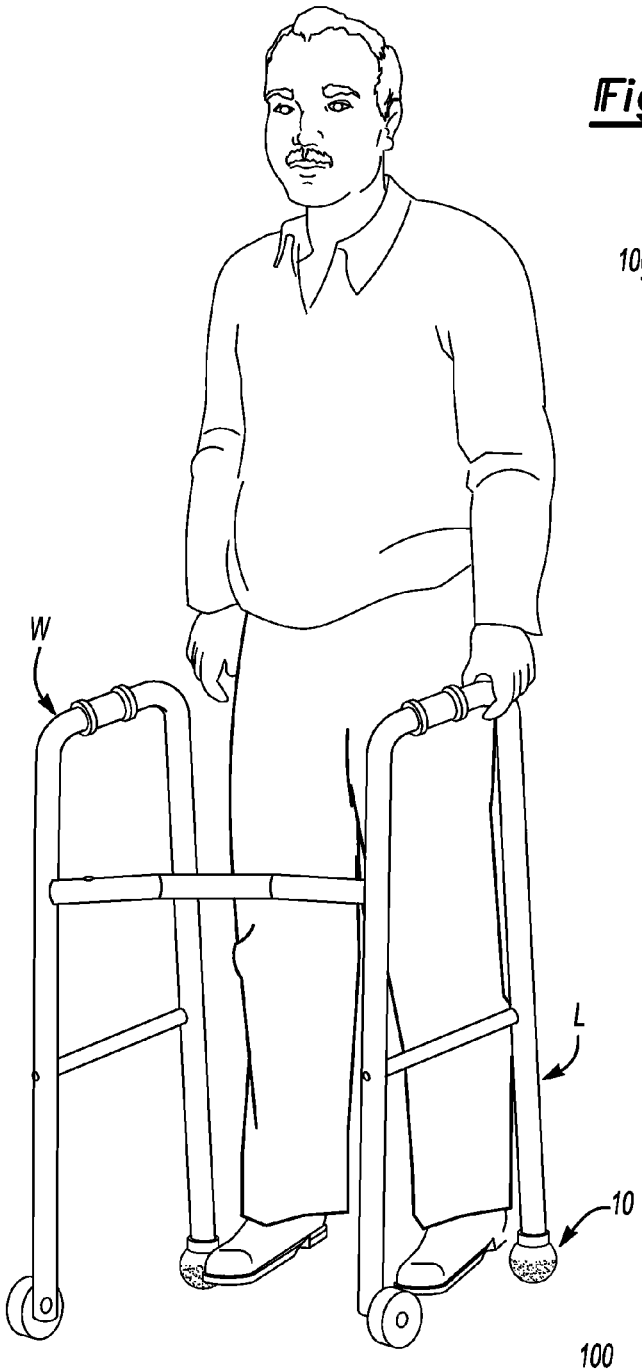
FIG. 1 is a perspective view of a walker with an embodiment of the present invention attached to the rear legs thereof.
Figure 2:
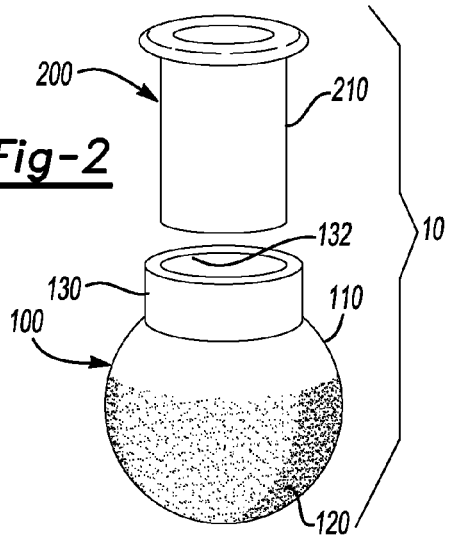
FIG. 2 is a perspective view of an embodiment of the present invention.
Figure 3:
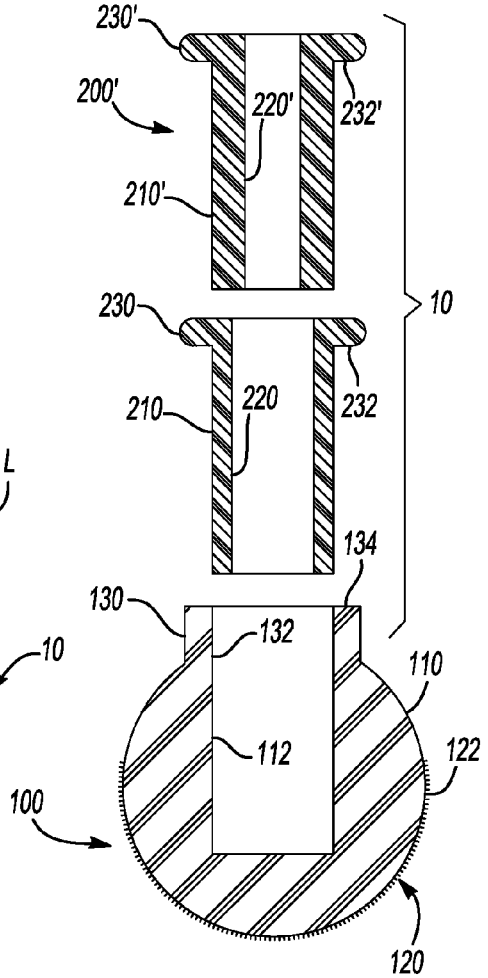
FIG. 3 is a side view of an embodiment of the present invention.

Turning now to FIGS. 1-3, an embodiment of the walker leg tip is shown generally at reference numeral 10. In particular, FIG. 1 illustrates an individual standing adjacent to a walker W with a walker leg tip 10 attached to an end portion of a rear walker leg L. Attachment of the walker leg tip 10 onto the end portion of the walker leg L as shown in FIG. 1 prevents a chirping noise and provides vibration dampening when the individual uses the walker W to assist in walking. It is appreciated that some walkers have wheels on the front legs and thus the walker leg tip 10 will be used on the back or rear legs. However, it is further appreciated that the walker leg tip 10 can also be used on the front legs of a walker if so desired.

Looking now at FIGS. 2 and 3, the walker leg tip 10 can include an arcuate shaped shell 100, the shell 100 having a top portion 110 and a bottom portion 120. In some instances, the arcuate shaped shell 100 can be spherically shaped, although this is not required. As indicated above, felt nap 122 is provided on the bottom portion 120 of the shell 100. The top portion 110 has an aperture 112 at least partially therethrough, the aperture 112 dimensioned to accept the end of the walker leg L. In addition, the top portion 110 can optionally include a sleeve 130 extending therefrom. The sleeve 130 has an aperture 132 that can be dimensioned to fit at least partially on the end of walker leg L and can be in alignment with the aperture 112. A removable insert 200 can also be provided, the insert 200 having an outer diameter 210 that is dimensioned to fit at least partially into the aperture 112 of the arcuate shaped shell 100 and/or the aperture 132 of the sleeve 130.

The removable insert 200 can include a lip 230 that has a bottom surface 232 that comes into contact with a top surface 134 of the sleeve 130 when the insert 230 is placed within the aperture 112 and/or aperture 132. In this manner, the insert 200 can be placed firmly within the arcuate shaped shell 100 and thereafter removed.

The insert 200 has an inner diameter 220 that is dimensioned to fit at least partially onto the end portion of the walker leg L. It is appreciated that the inner diameter 220 is dimensioned such that an interference fit can be provided between the insert 200 and the end portion of the walker leg L. It is further appreciated that the outer diameter 210 can be dimensioned such that the insert 200 can have an interference fit with the arcuate shaped shell 100 and/or the sleeve 130. Although an interference fit can provide attachment of the insert 200 to the shell 100 and/or walker leg L, other methods, devices, etc. can be used to provide attachment, illustratively including the use of adhesives, snaps, spring loaded pins, threaded fasteners, tape and the like. A second insert 200' is shown in FIG. 3, the insert 200' simply illustrating that inserts having different sized inner diameters can be placed at least partially within the arcuate shaped shell 100 and/or sleeve 130 such that the arcuate shaped shell 100 can be used on walkers having walker legs L with different diameters. In this manner, an improved walker leg tip is provided.

The invention is not restricted to the illustrative examples and/or embodiments described above. The examples and/or embodiments are not intended as limitations on the scope of the invention. Methods, apparatus, compositions and the like described herein are exemplary and not intended as limitations on the scope of the invention. Changes therein and other uses will occur to those skilled in the art. The scope of the invention is defined by the scope of the claims.

I claim:

1. A walker leg tip for attaching to an end portion of a walker leg, said walker leg tip comprising:

a shell having a generally spherical shape, said shell having a top portion and bottom portion;

said top portion having an aperture at least partially therethrough;

a sleeve extending from said top portion, said sleeve having a sleeve aperture in alignment with said top portion aperture and dimensioned to fit at least partially onto the end portion of the walker leg;

a felt nap covering at least part of said bottom portion; and said sleeve being removable and having an outer circumference dimensioned to fit within said top portion aperture and an inner circumference dimensioned to fit onto the end portion of the walker leg.

2. The walker leg tip as defined in claim 1 and including a second sleeve having a sleeve aperture dimensioned to fit onto the end portion of a second walker leg of a different dimension than said first mentioned walker leg.

3. The walker leg tip of claim 1, wherein said shell is made from a polymer.

4. The walker leg tip of claim 1, wherein said shell is made from a vulcanized rubber.

* * * * *